US005515567A

United States Patent [19]

Washburn

[11] Patent Number: 5,515,567

[45] Date of Patent: May 14, 1996

[54] PAINT ROLLER CLEANING DEVICE

[76] Inventor: Don L. Washburn, 1402 Moon Ter., Medford, Oreg. 97504

[21] Appl. No.: 341,682

[22] Filed: Nov. 16, 1994

[51] Int. Cl.[6] ..... A47L 25/00; B05C 21/00; B08B 1/00

[52] U.S. Cl. ..... 15/3; 15/236.03

[58] Field of Search ..... 15/236.03, 1, 3, 15/245; 134/138, 139, 149

[56] References Cited

U.S. PATENT DOCUMENTS

| | | | |
|---|---|---|---|
| 2,773,274 | 12/1956 | Beech | 134/149 |
| 3,373,456 | 3/1968 | Dalton | 15/1 |
| 4,287,631 | 9/1981 | Marrs | 15/105 |
| 4,320,550 | 3/1982 | McGrew | 15/3 |
| 4,402,333 | 9/1983 | Frizzell | 134/138 |
| 4,667,361 | 5/1987 | Wolcott | 15/236.03 |
| 5,095,928 | 3/1992 | Phipps | 134/138 |

*Primary Examiner*—Mark Spisich

[57] ABSTRACT

A hand operated paint roller cleaning apparatus (10) which extracts residual reusable paint (33). Mechanically advanced by a one-way drive (25) the roller brush (32) is conveyed longitudinally through the aperture (26). The aperture (26) supports a circular wiper (15) which has a interference fit when contacting with the nap of the roller (32). The trigger handle (12) when compressed increments the roller (32) through the aperture (26) expelling the paint (33) and wringing the roller nap (32).

1 Claim, 3 Drawing Sheets

PAINT ROLLER CLEANING DEVICE

BACKGROUND

1. Field of Invention

This invention relates to a device for removing the excess paint and cleaning paint rollers.

2. Description of Prior Art

The use of the roller paint brush is a very fast and economical way to apply paint to flat surfaces but also it can be a wasteful and messy tool to clean.

There have been many previous devices for the removal of paint from the roller but they have either been cumbersome to use or costly to manufacture. Many roller cleaning devices use a cylinder regulated water spray system , such as U.S. Pat. No. 4,402,333 by Frizzel and U.S. Pat. No. 5,095,928 by Phipps. The devices must be hooked up to a water supply and then the roller must be secured inside the cylinder. The devices use a lot of water and they do not reclaim the excess paint from the roller brush. Other devices such as U.S. Pat. No. 3,373,456 by Dalton uses a scraping apparatus and can be awkward to use. Its design of two opposing concave fork shape handles which are varied in pressure against the roll in the downward motion gives it its awkwardness. The device may scrape the paint off by the skilled user but not as effectively as in this invention. U.S. Pat. No. 4,667,361 by Wolcott & Croix is a scraping device which clamps around the roller. Grabbing the roller handle in one hand and squeezing on the cleaning device with the other hand will scrape the paint off the roller. The device can be messy to use.

OBJECTS AND ADVANTAGES

The prior apparatuses were on the right track but lacked in simplicity and effectiveness as in this invention. The present invention is capable of extracting the excess paint from a used roller brush which expels the paint into a container to be reused. A minimal amount Of paint is left on the roller brush making the roller brush easy to wash off with additional water and this invention. This device has simplicity in its design and .extracting effect by wringing the roller brush for excess paint first and then cleaning afterwards. Further objectives and advantages of my invention will become apparent from a consideration of the drawings and following description.

BRIEF DESCRIPTION OF THE DRAWINGS

Other advantages and features of the invention are described with reference to exemplary embodiments, which are intended to explain and not to limit the invention, and are illustrated in the drawings in which.

DESCRIPTION OF THE PREFERRED EMBODIMENT

Figure 1:
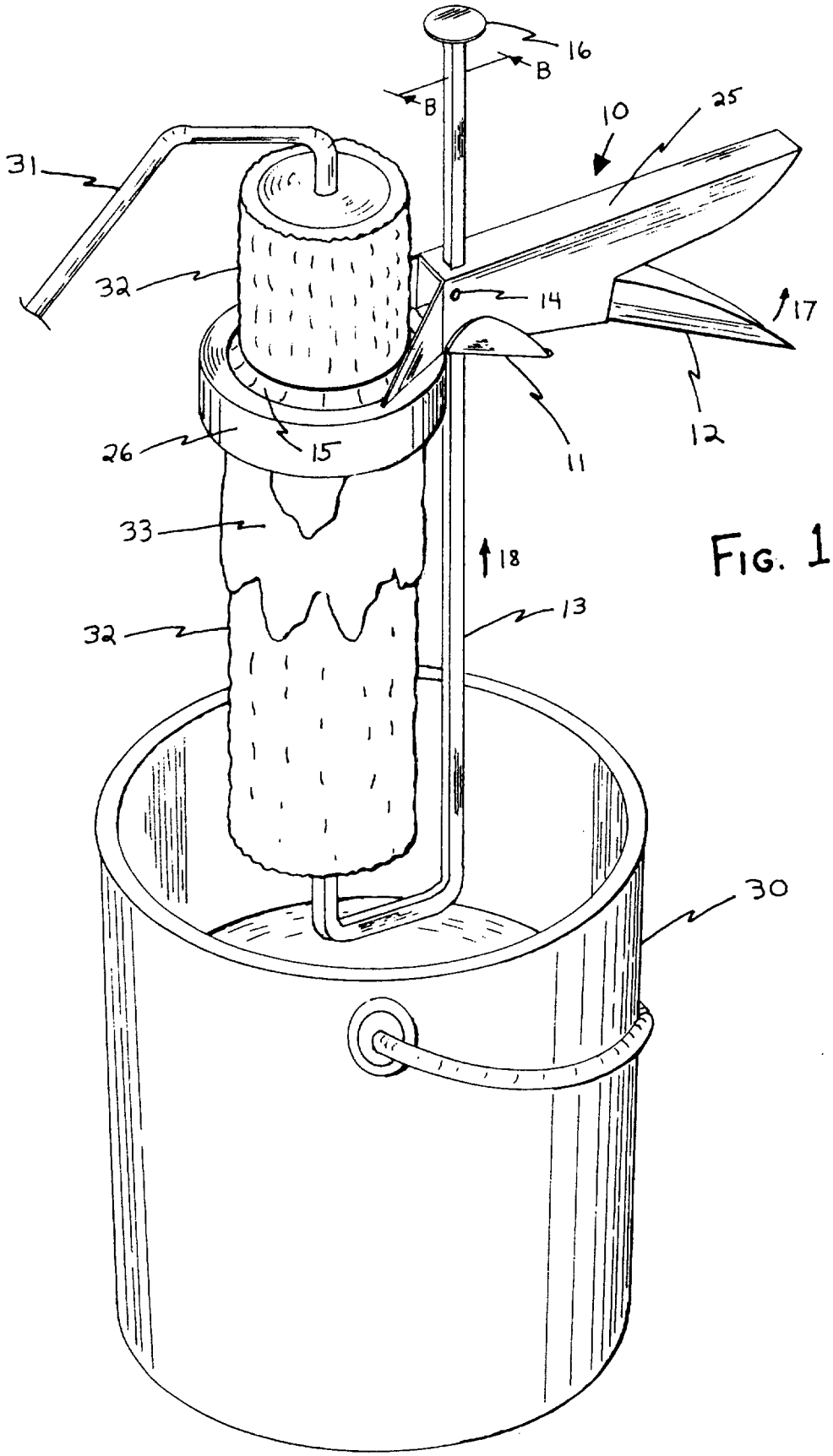
FIG. 1 is an elevational view of the device removing paint from a roller brush into a paint can.

Referring to the drawings, the device which is used as a paint extractor and/or roller brush cleaner 10 comprises a main rigid body 25 which can be made of any suitable material such as a malleable metal or a moldable plastic. Body 25 supports the aperture 26 which is means for containing the wiper 15. Wiper 15 is made usually of a flexible material such as rubber or a soft plastic of a circular design which will perform the scraping effect on the nap of the roller brush 32 when forced through the orifice of wiper 15. Scraping the nap on roller brush 32 removes the excess paint 33 into the paint container 30 which allows salvage of residual paint.

Figure 2:
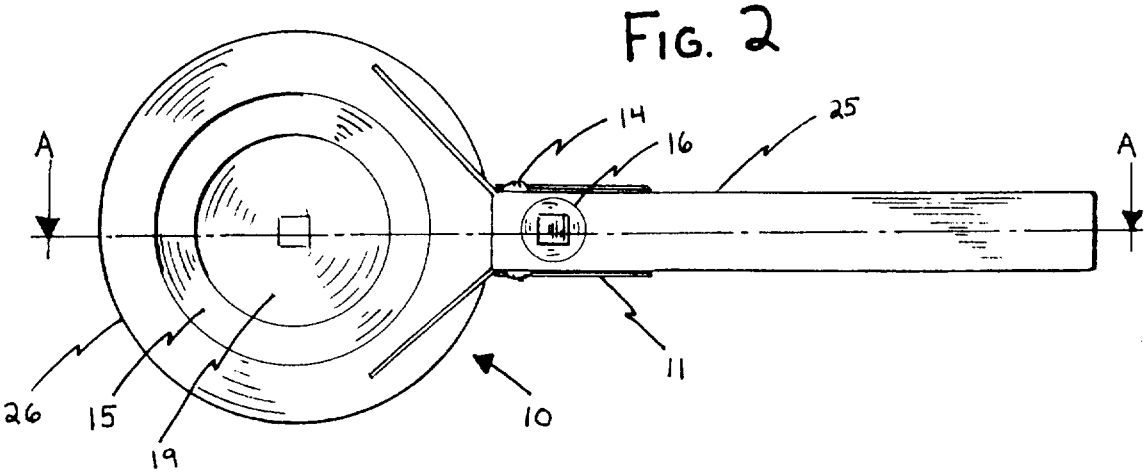
FIG. 2 is a top plan view of the apparatus.
Figure 3:
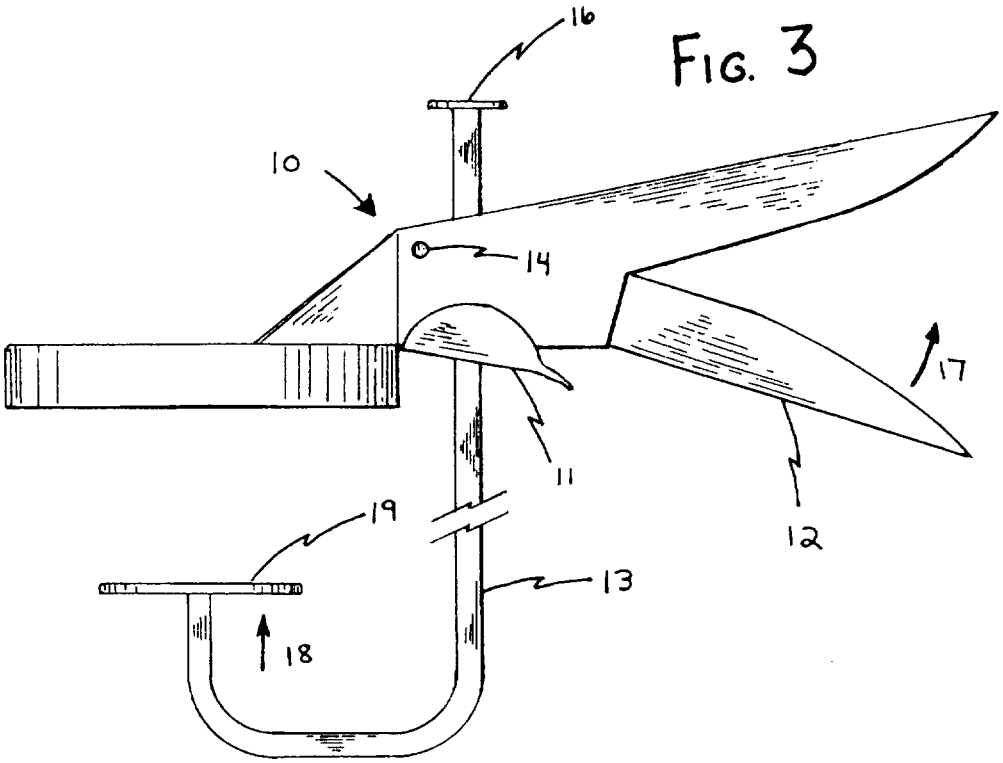
FIG. 3 is a side plan view of the apparatus.
Figure 4:
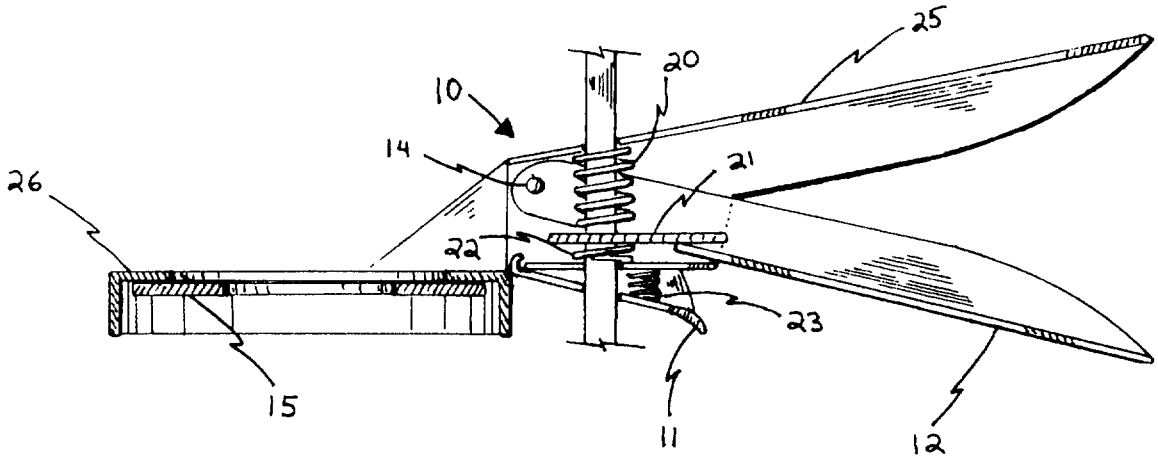
FIG. 4 is a cross-sectional view of the cleaning apparatus taken along the line a—a in FIG. 2 and looking in the direction of the arrows.
Figure 5:
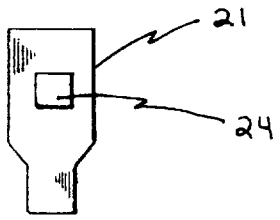
FIG. 5 is a plan view of the driving device.
Figure 6:
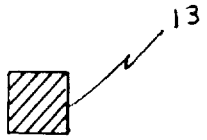
FIG. 6 is a cross-sectional view of the slide bar taken along the line b—b in FIG. 1 and looking in the direction of the arrows.

Roller brush 32 is forced through wiper 15 by means of the slide bar 13 and the pusher 19 in the direction of the arrow 18 which runs parallel to roller brush 32 and perpendicular to body 25. Slide bar 13 is made of a rigid metal such as steel, brass or aluminum in a square cross sectional design as shown in FIG. 6. The square design maintains the longitudinal alignment between pusher 19 and aperture 26 during the scraping and cleaning cycle as shown in FIG. 2.

Slide bar 13 increments in the direction of arrow 18 through body 25 by moving the trigger handle 12 in the direction of arrow 17. Trigger handle 12 moves on the pivot pin 14 in the direction of arrow 17 which causes the driving lever 21 to bind and move slide bar 13 in the direction of arrow 18. After trigger handle 12 has been compressed in the direction of arrow 17 the braking lever 11 binds slide bar 13 from moving the opposite direction of arrow 17. The spring 20 unbinds driving lever 21 when trigger handle 12 retracts back to its normal state, which lets driving lever 21 move back to its normal state by spring 20 equalizing with the spring 22. Braking lever 11 is held in a binding mode on slide bar 23 by the spring 23. Braking lever 11 will release its bind on slide bar 13 by moving brake lever 11 in the direction of arrow 28. Slide bar 13 will extend out by pushing on the slide bar stop 16 and holding break lever 11 in the direction of arrow 28.

OPERATION

In using the present invention body 25 and trigger handle 12 must be firmly gripped. Slide bar 13 must be extended out by pulling on braking lever 11 and pushing on slide bar stop 16 until fully extended. The end of the roller brush handle 31 is then fed through the center of aperture 26 until the nap of roller brush 32 meets wiper 15. Trigger handle 12 is squeezed repetitively until pusher 19 makes contact with the outward end of roller brush 32. Roller brush 32 will now pass incrementally through wiper 15 expelling paint 33 into paint container 30. The first cycle through the embodiment removes a measurable amount of paint 33. Roller brush 32 is them dipped in a bucket of clean water and then cycled again through the device which will remove the water diluted residual paint. This process is repeated as necessary in clean water.

It is to be understood that the invention disclosed herein is not limited to the details of construction and arrangements of parts illustrated in the accompanying drawing, but is capable of being practiced or carried out in various ways. Furthermore, the terminology employed herein is for the purpose of description and is not to be considered as a limitation.

It is obvious to those skilled in the art that although the invention has been shown and described in a preferred embodiment, many variations may be made in the form and structure here presented without departing from the scope of the present invention as set forth in the appended claims.

I claim:

1. A paint roller cleaning device comprised of:

a. a main body portion having a circular aperture formed therein and wiper means mounted on the periphery of said aperture and extending inwardly therefrom;

b. a handle means on said main body portion and including a pivoted lever portion;

c. a slide bar having an upper end extending through an opening in said main body portion and having a pusher portion mounted on the lower end with said pusher portion being in axial alignment with said aperture;

d. a driving lever mounted on said main body and drivingly engaging said slide bar, said driving lever being engaged by said pivoted lever portion such that pivoting said pivoted lever portion causes said driving lever to engage said slide bar to move said slide bar to move said pusher portion toward said aperture such that a paint roller mounted on said pusher portion can be moved through said aperture and wiped by said wiper means when said pusher portion is advanced towards said aperture;

c. and an engageable braking means on said main body portion to engage said slide bar to prevent downward movement of said slide bar during disengagement with said driving lever and disengageable to provide for downward movement of said slide bar to move said pusher portion away from said aperture.

* * * * *